United States Patent [19]

Arieh et al.

[11] Patent Number: 4,922,632

[45] Date of Patent: May 8, 1990

[54] SKI BOOT

[75] Inventors: Simon Arieh, Geneva; Guy Courvoisier, Celigny, both of Switzerland

[73] Assignee: Lange International S.A., Switzerland

[21] Appl. No.: 399,855

[22] Filed: Aug. 29, 1989

[30] Foreign Application Priority Data

Oct. 10, 1988 [CH] Switzerland ..... 3774 88

[51] Int. Cl.[5] ..... A43B 5/04

[52] U.S. Cl. ..... 36/117; 36/120; 36/121

[58] Field of Search ..... 36/117, 118, 119, 120, 36/121

[56] References Cited

U.S. PATENT DOCUMENTS 4,601,118 7/1986 Zanatta ..... 36/120

4,761,899 8/1988 Marxer ..... 36/121

FOREIGN PATENT DOCUMENTS 316605 10/1988 European Pat. Off. ..... 36/117

*Primary Examiner*—Paul T. Sewell

*Assistant Examiner*—Andrew D. Meyers

*Attorney, Agent, or Firm*—Kane, Dalsimer, Sullivan, Kurucz, Levy, Eisele and Richard

[57] ABSTRACT

Ski boot having an articulated shank comprising means for fixing or releasing the shank for rotation, means for adjusting the inclination of the shank and an elastic element (15), the elasticity of which is adjustable. The adjustable inclination is achieved by means of a shank in two parts, the length of which is adjustable by means of a button (12). The locking or the release for rotation is obtained by means of a sliding locking member (24) interacting with a V-shaped bolt (16) itself interacting with cut-outs (19) in a cradle fixed to the shank (2). The elasticity of the elastic element (15) is ensured by the displacement of a sliding rigid sleeve (19) around the elastic element (15), which displacement is controlled by a button (32).

5 Claims, 5 Drawing Sheets

SKI BOOT

FIELD OF THE INVENTION

The present invention relates to a ski boot composed of at least one lower part intended to surround the foot and the heel, and a shank articulated on this lower part and comprising, at the rear, connecting means between the shank and the lower part, these connecting means comprising means for fixing or releasing the shank for rotation relative to the lower part, means for adjusting the inclination of the shank relative to the lower part of the boot by means of a screw/nut system, in elastic element and means for adjusting the elasticity of this elastic element.

PRIOR ART

A boot provided with locking means for the shank which are capable of being unlocked in order to permit the pivoting of this shank, and means permitting the inclination of the shank in the locked position to be adjusted, is described in patent FR 2,491,304. The device used comprises a lever articulated at its end to a stirrup fixed to the inner part of the boot and, at an intermediate point, by means of sliding nut carried by a threaded rod forming part of the lever, to the end of a connecting rod articulated to a stirrup fixed to the shank. The threaded rod is provided with gripping means enabling it to be rotated in order to move the sliding nut. Consideration has been given to replacing the connecting rod with an adjustable elastic connection such as described in patent US-3,619,914. The introduction of such an elastic mechanism would, however, substantially increase the bulk of the device. Moreover, in the walking position, when the shank pivots on the lower part of the boot, all the articulations are stressed and impede the movement of the shank.

A simple device using neither screw nor nut is known from patent CH-549,970. This device comprises an elastic stirrup whose two angled arms engage in holes on either side of an element fixed to the lower part of the boot. When the lever is pushed downwards, the shank is released, but simultaneously the adjustment of the inclination of the shank is lost. Moreover, the connecting device possesses no elasticity.

A lockable and unlockable connecting device having an elastic ball-and-socket joint is likewise known from patent EP 0,248,149. This device does not make it possible to adjust the inclination of the shank.

The object of the present invention is to provide a compact device making it possible to accomplish the three abovementioned functions, namely locking and unlocking of the shank of the boot, adjustment of the inclination of the said shank and adjustment of the flexial strength of said shank. The device is not to comprise any articulation of lever projecting in the unlocked position and/or caused to pivot during walking.

SUMMARY OF THE INVENTION

The boot according to the invention is characterized in that the connecting means comprise a bar, in two parts mutually connected by a threaded part, extending parallel to the back of the shank, and the lower end of which is attached to the lower part of the boot, a control button fixed to the upper part of the shank to adjust the length of the bar, an elastic sleeve of non-compressible material surrounding the shank and subject to compression between a stop and a locking member mounted to slide on the shank between the elastic element and said button, said locking member interacting, in order to lock the shank on the lower part of the boot, with at least one notch provided in the shank, a control member for the locking member mounted to slide parallel to the shank and capable of occupying two stable positions, one for locking and the other for unlocking the shank, a sliding rigid sleeve surrounding the elastic sleeve and means for displacing said rigid sleeve along the elastic sleeve in order to modify the length of the part of the elastic element situated outside the rigid sleeve and consequently capable of undergoing deformation by expansion.

The only articulation is formed by the attachment of the connecting bar to the lower part of the boot, the other members being sliding.

The locking member is preferably formed by an element which is elastically mounted or subject to elastic flexion, but it could also perform a simple rotation around the bar.

The device can be produced in a particularly compact manner by providing a control for the sliding rigid sleeve through a cut-out in the control member of the locking member.

BRIEF DESCRIPTION OF THE DRAWINGS

The attached drawing shows, by way of example, an embodiment of the invention.

DESCRIPTION OF THE PREFERRED EMBODIMENTS

Figure 1:
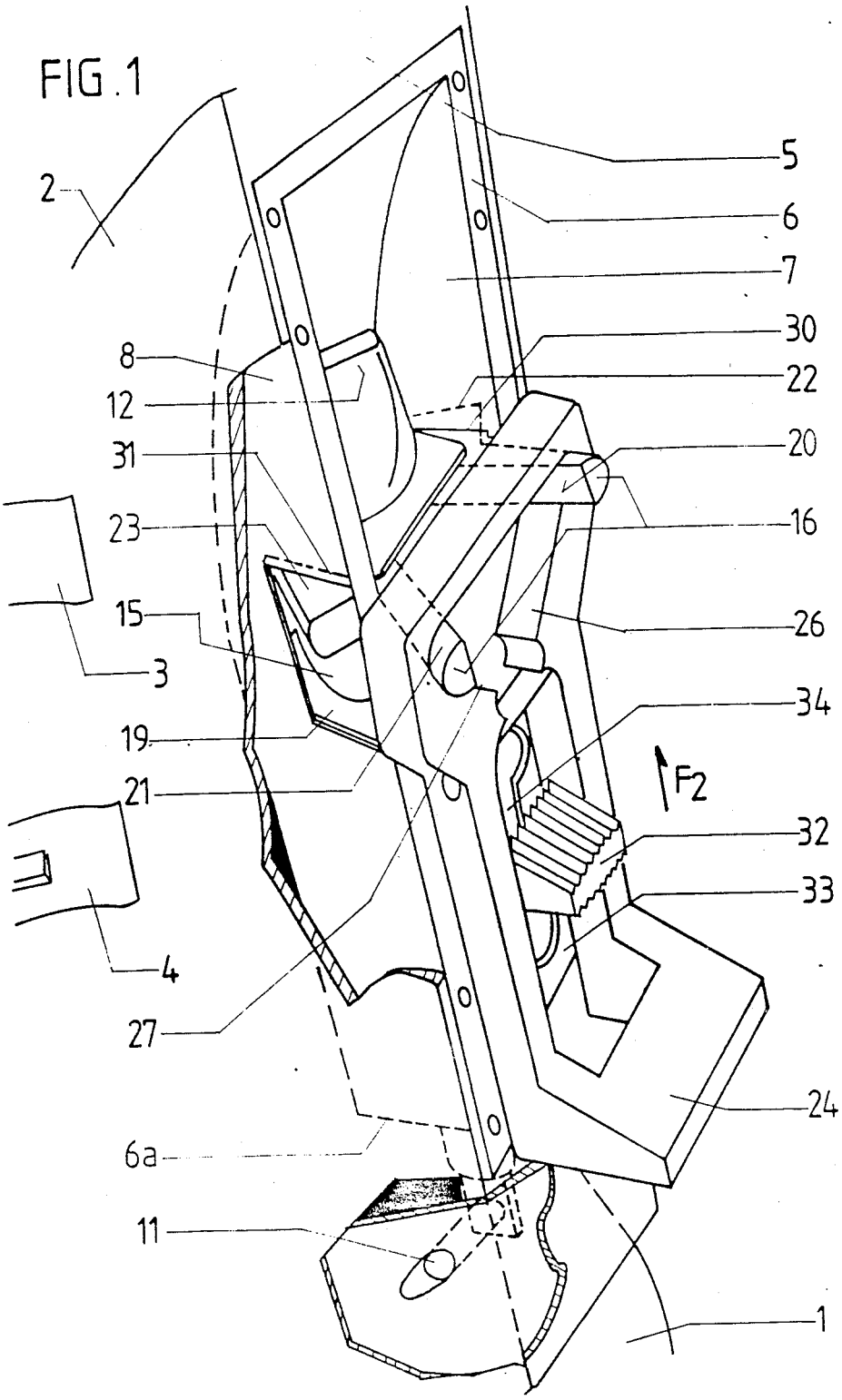
FIG. 1 is a partial perspective view of part of the rear of the boot, showing the connecting device in the locked position.
Figure 2:
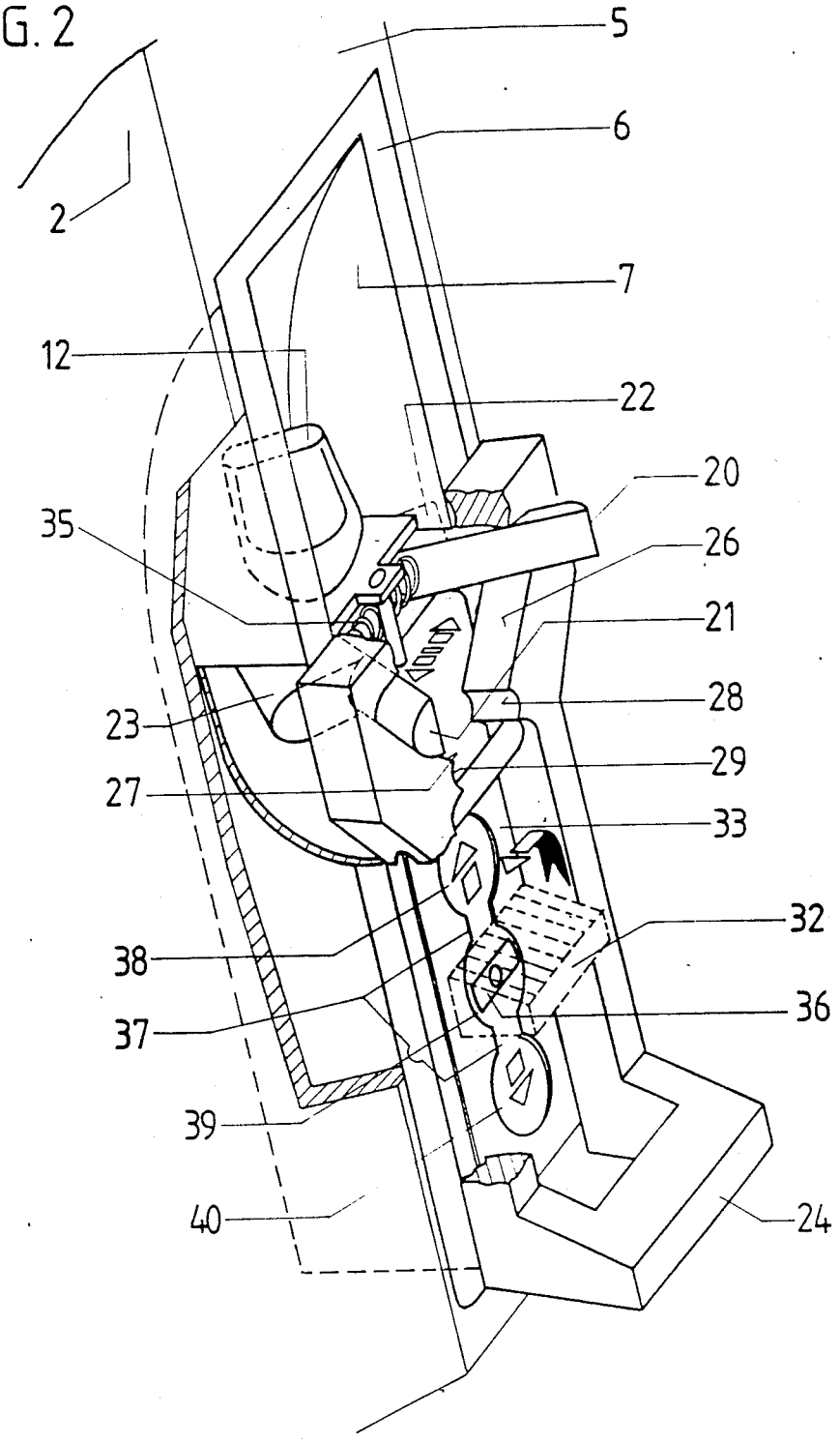
FIG. 2 is a view of this same connecting device in the locked position, but without the boot.
Figure 3:
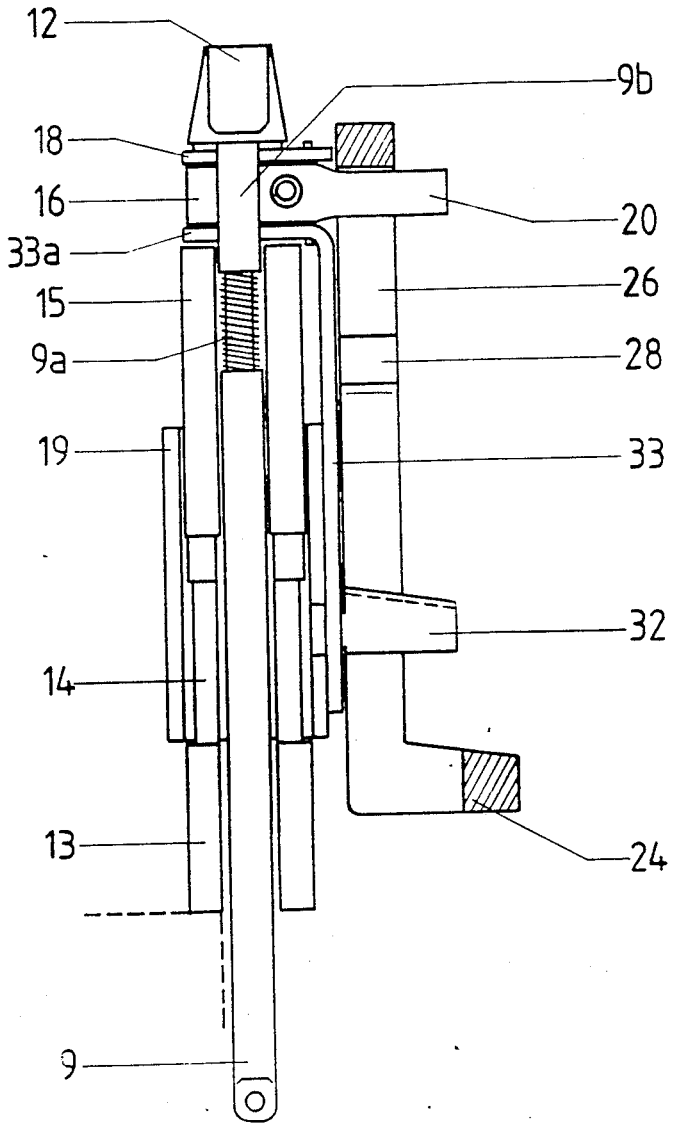
FIG. 3 is a view in axial section of the device shown in FIG. 2.
Figure 4:
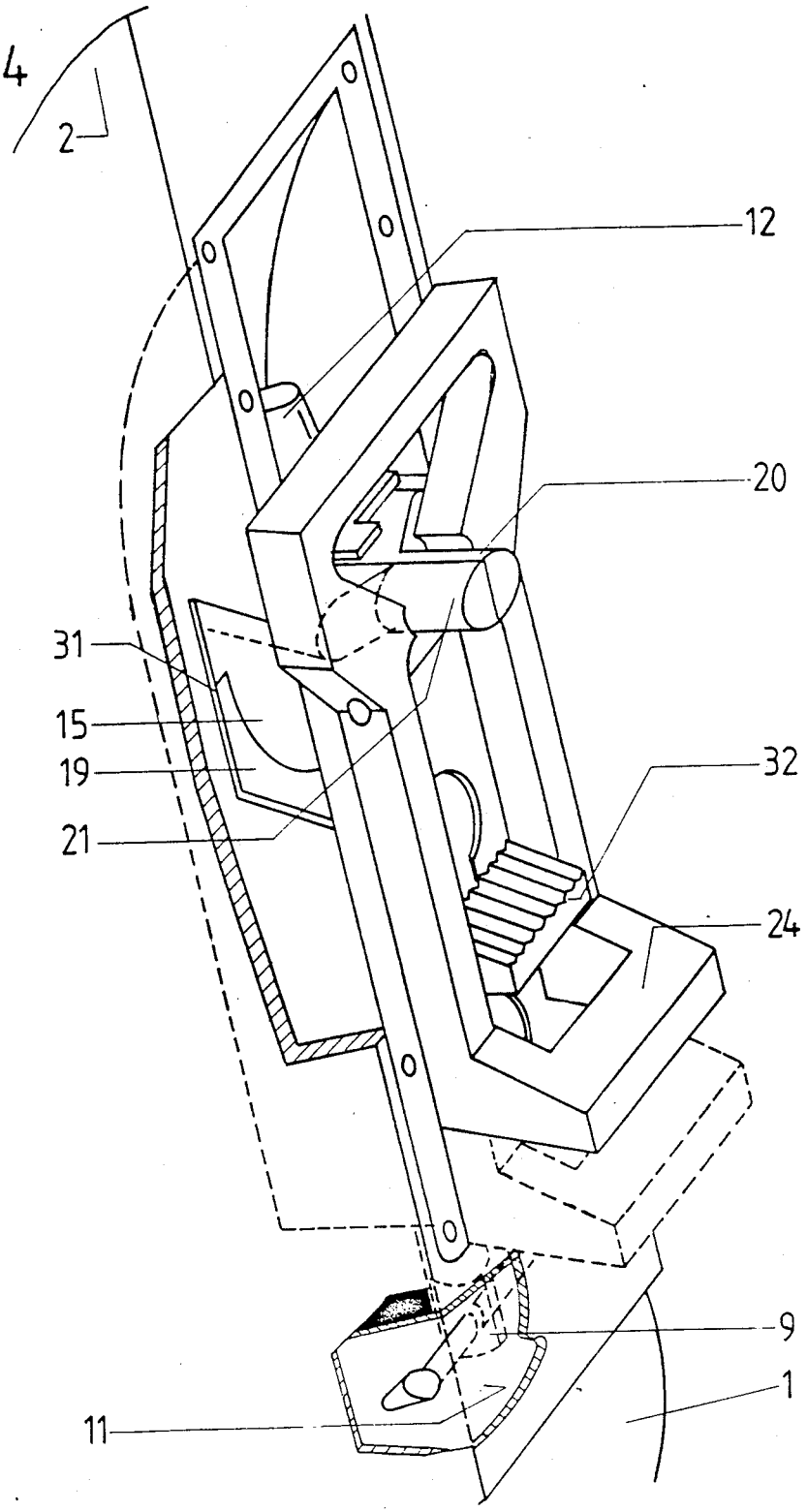
FIG. 4 is a view analogous to that in FIG. 1, but showing the connecting device in the unlocked position.

The boot is a boot similar to the boot shown in FIG. 1 of patent FR 2 491 304, and comprises, like the latter, a lower part or shell base 1 surrounding the foot and the heel, and a shank articulated on the lower part. The ends of the two upper straps 3 and 4 for tightening the shank have also been shown diagrammatically. This shank 2 possesses a flat back 5 provided with a rectangular cut-out in which is fixed a metal cradle 6 of rectangular shape possessing, in particular, two parallel vertical lateral walls 7 and 8. The connecting device, shown alone in FIGS. 2 and 3, is accommodated in the cradle 6.

This connecting device comprises a cylindrical bar 9 whose lower end is provided with a hole 10 through which the bar 9 is attached to the shell base 1 by means of a spindle 11. The upper end **9*a* of the bar 9 is threaded and is screwed into a rod-end 9*b* fixed to a button 12 which can be actuated manually. The length of the bar 9 is thus variable. Around the bar 9 is fitted a ring 13 which bears on the base 6*a* of the cradle 6 which forms a stop for the connecting device. The ring 13 is fixed to a rigid cylinder 14. Above this cylinder 14 is placed a cylindrical sleeve 15 of an elastic material which is not volumetrically compressable, through which the bar 9** likewise passes. Between the button 12 and the elastic sleeve 15 is fitted a bolt 16, between a small square plate 18 and the angled part 33*a* of a plate 33 extending parallel to the bar 9. The small plate 18 and the angled part 33*a* act as washers mounted freely on the bar 9. Around the elastic sleeve 15 is fitted a rigid sleeve 19 whose interior diameter is just sufficient to permit this sleeve 19 to slide on the elastic sleeve 15, in order to modify the length of the part of the elastic sleeve 15 situated outside the sleeve 19, in such a manner as to adjust the elastic strength of the elastic sleeve 15 as described in patent EP 0 206 394. The sleeve 15 is, for example, of rubber. The rigid sleeve 19 is fixed to the button 32 capable of being displaced in accordance with the double arrow F1 above the plate 33.

The lock 16 takes the form of two mutually articulated arms 20 and 21 which are held apart in a V shape by a spring 35. These arms are fitted with lugs 22 and 23 respectively, directed laterally outwards. The lock 16 interacts with a control member 24 formed by a piece of generally rectangular shape mounted to slide on the cradle 7. In its upper part, the control member 24 possesses a cut-out 25 of triangular shape whose two sides 26 and 27 form ramps for the actuation of the lock 16. At its apex, the triangle 25 is truncated and the ends of the ramps 26 and 27 terminate in seatings or notches 28 and 29 respectively. In the position shown in FIGS. 1 and 2, the lugs 22 and 23 of the lock 16 are engaged respectively in rectangular cut-outs 30 and 31 provided in the walls 7 and 8 of the cradle 6.

In the position shown in FIG. 1, the lock 16 is spread, and its lugs 22 and 23 are engaged in the cut-outs 30 and 31 of the shank, in which they abut against the upper edges of said cut-outs, forcing shank 2 to adapt a certain inclination towards the front of the boot, which position is called "advanced", for skiing. The cut-outs 30 and 31 possess a large vertical offset below the lock 16 so as to permit the flexion of the shank during descent. To release the shank 2, it is sufficient to press the control member 24 upwards in the direction of the arrow F2. The lock 16 is then closed by the ramps 26 and 27, the arms 20 and 21 of the lock coming to be seated in the seatings 28 and 29, as shown in FIG. 3. The lock 16 is then released from the cut-outs 30 and 31, in such a manner that it is possible to straighten the shank 2 of the boot, which can then pivot on the shell base 1. This is the rest or walking position.

Figure 5:
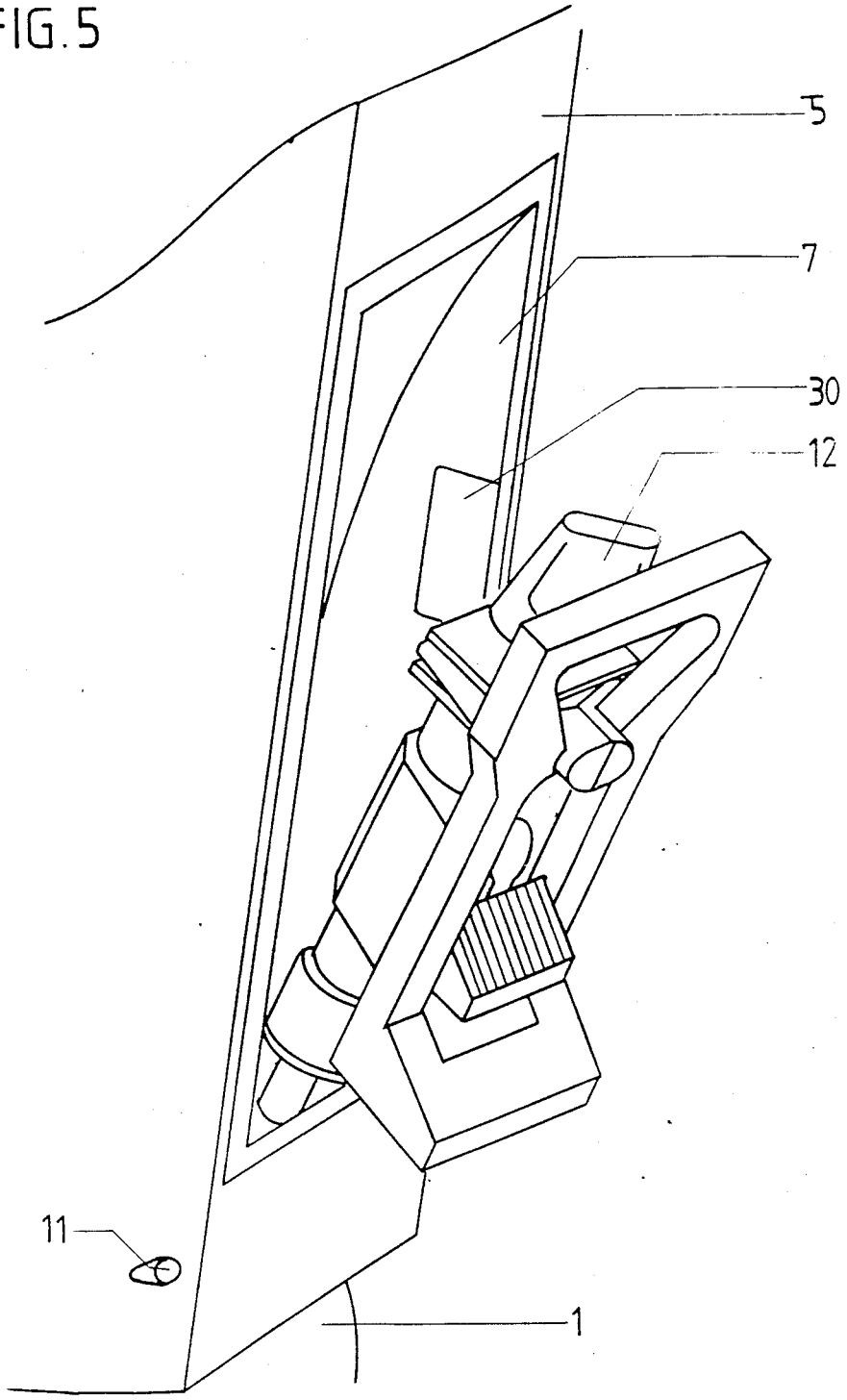
FIG. 5 shows the device away from the boot in order to adjust the inclination.

It is also in this position that the inclination of the shank 2 can be adjusted into a position which is locked by turning the button 12. For this purpose, the connecting device is released from its cradle 6 by swinging it backwards about the spindle 11, as shown in FIG. 5. In this position it is easy to grip the button 12.

The effect of rotating the button 12 is to elongate or shorten the length of the bar 9, that is to say the distance between its point of attachment 11 to the shell base 1 and the lock 16, and consequently to adjust the inclination of the shank 2 of the boot. The connecting device is then swung down into the cradle 6.

To revert to the descending position, it is sufficient to push the control member 24 back downwards in the direction of the arrow F3 to release the lock 16. On the next forward flexion of the shank 2, the lock 16 then engages in the cut-outs 30 and 31.

As already stated above, the button 32 makes it possible to displace the rigid sleeve 19 along the elastic sleeve 15, and hence to modify the length of the elastic part of the sleeve 15 situated outside the rigid sleeve 19, which is capable of undergoing expansive deformation under the action of an axial compression, that is to say of modifying the hardness of the elastic shock-absorber represented by the elastic sleeve 15 when the shank 2 of the boot is stressed backwards. In the example shown, the mobile sleeve 19 can be locked in three different positions by means of a rotary connection between the sleeve 19 and its button 32 and by means of an oblong intermediate part 36, having rounded ends, interacting with a slot 37 in the plate 33 joining three circular cut-outs 38, 39 and 40 of a diameter corresponding to the length of the oblong part 36. By rotating the button 32 it is possible to orient the oblong part 36 parallel to the slot 37, in a manner such that it is possible to displace this oblong part 36 from one end to the other of the slot 37. By bringing the oblong part 36 into a position transverse to the slot 37 in one of the circular cut-outs 38, 39 or 40, the button 32 is locked in this position. It would of course be possible to increase the number of locked positions.

It would also be possible to introduce into the device an elastic element for the forward flexion of the shank of the boot. This could be simply done by interposing a tension spring in the bar 9 or a compression spring between the button 12 and the small plate 18. This compression spring could be replaced by an adjustable device analogous to the sleeves 15 and 19.

The lock 16 could be embodied in various alternative ways. It could for example take the form of a single flexible V-shaped piece or a circular piece mounted to rotate about the bar 9 and provided with two radial fingers, one forming the lock and the other an actuating arm interacting with an oblique groove in the control member 24, displacement of which would cause the lock to participate in rotation. The lock could likewise be formed of two rods undergoing a radial translatory movement and each provided with an arm perpendicular to the rods and interacting respectively with two oblique grooves in the control member 24.

We claim:

1. A ski boot composed of at least one lower part (1) intended to surround the foot and the heel, and a shank (2) articulated on this lower part and comprising, at the rear, connecting means between the shank and the lower part, these connecting means comprising means (16) for fixing or releasing the shank for rotation relative to the lower part, means for adjusting the inclination of the shank relative to the lower part by means of a screw/nut system (9, 12), an elastic element (15) and means for adjusting the elasticity of this elastic element (19), wherein the connecting means comprise a bar (9), in two parts mutually connected by a threaded part, extending parallel to the back of the shank (5), and the lower end of which is attached to the lower part of the boot (1), a control button (12) fixed to the upper part of the shank to adjust the length of the bar, an elastic sleeve of non-compressible material (15) surrounding the shank and subject to compression between a stop (6*a*) and a locking member (16) mounted to slide on the bar (9) between the elastic element (15) and said button (12), said locking member (16) interacting, in order to lock the shank on the lower part of the boot, with at least one notch provided in the shank, a control member for the locking member (24) mounted to slide parallel to the shank and capable of occupying two stable positions, one for locking and the other for unlocking the shank, a sliding rigid sleeve (19) surrounding the elastic sleeve (15) and means (32) for displacing said rigid sleeve along the elastic sleeve in order to modify the length of the part of the elastic element situated outside the rigid sleeve and consequently capable of undergoing deformation by expansion.

2. The boot as claimed in claim 1, wherein the locking member (16) is formed by two arms (20, 21) articulated in a V-shape, held apart by a spring (35) and interacting respectively with two converging ramps (26, 27) provided on the control member of the lock (24) ensuring the tightening of said arms (20, 21) during its displacement in the converging direction, two pairs of seatings or notches being respectively provided at the ends of said ramps to maintain the locking member in the locking position and unlocking position, respectively, of the shank, and wherein the lower parts of the arms of the locking member are fitted with lateral lugs (22, 23) respectively interacting with two notches (30, 31) provided in the shank.

3. The boot as claimed in claim 2, wherein the connecting means are mounted in a metal cradle (6) inserted in the back (5) of the shank, the said notches (30, 31) being provided in the lateral walls of said cradle, the locking control member (24) being mounted to slide on this cradle, and it being possible for the connecting means to be swung out of said cradle in order to actuate said control button (12).

4. The boot as claimed in claim 3, wherein the locking control member (24) possesses a central cut-out through which projects a drive button (32) for said sliding sleeve (19) in order to regulate the elasticity of the shank in backward flexion.

5. The boot as claimed in claim 4, wherein the said drive button (32) for the sliding sleeve is guided by a slot (37) provided in a plate (33) extending parallel to the bar (9), between said bar and the locking control member (24).

* * * * *